US008379904B2

(12) United States Patent
Liu et al.

(10) Patent No.: US 8,379,904 B2
(45) Date of Patent: Feb. 19, 2013

(54) ELECTROACOUSTIC VIBRATING TRANSDUCER

(75) Inventors: Lin Liu, Shenzhen (CN); Xu-Dong Yan, Shenzhen (CN)

(73) Assignees: AAC Acoustics Technologies (Shenzhen) Co., Ltd., Shenzhen (CN); AAC Technologies Pte. Ltd, Singapore (SG)

( * ) Notice: Subject to any disclaimer, the term of this patent is extended or adjusted under 35 U.S.C. 154(b) by 155 days.

(21) Appl. No.: 12/978,591

(22) Filed: Dec. 26, 2010

(65) Prior Publication Data

US 2012/0008816 A1 Jan. 12, 2012

(30) Foreign Application Priority Data

Jul. 9, 2010 (CN) ..... 2010 2 0256009 U

(51) Int. Cl.
*H04R 1/02* (2006.01)
*G10K 11/00* (2006.01)

(52) U.S. Cl. ..... 381/400; 381/401; 181/181

(58) Field of Classification Search ..... 381/400, 381/401, 421, 431, 386
See application file for complete search history.

(56) References Cited

U.S. PATENT DOCUMENTS 6,404,896 B1 * 6/2002 Yoo et al. ..... 381/401
2007/0187172 A1 * 8/2007 Kaneda et al. ..... 181/181

* cited by examiner

*Primary Examiner* — Curtis Kuntz
*Assistant Examiner* — Sunita Joshi
(74) *Attorney, Agent, or Firm* — IPro, Inc.; Na Xu

(57) ABSTRACT

An electroacoustic vibrating transducer is disclosed. The electroacoustic vibrating transducer includes a frame defines a hollow space, a yoke positioned in the hollow space, and a elastic member mounted on the frame. The elastic member includes a circular plane lamina and a plurality of elastic arms extending outwardly from the circumference of the circular plane lamina. The yoke includes a bottom wall and a sidewall extending vertically from the bottom wall, and the sidewall defines a plurality of gaps corresponding to the elastic arms. Each of the elastic arms is intermittently received in the gaps during the vibration of the elastic member.

5 Claims, 2 Drawing Sheets

ELECTROACOUSTIC VIBRATING TRANSDUCER

FIELD OF THE INVENTION

The present invention relates to transducers to be mounted in terminal equipments for converting electrical signals to audible sounds, and more particularly to an electroacoustic vibrating transducer.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speakers have been developed. The speaker is generally coupled to audio equipment or an amplifier for use as a large sound producing means for considerably amplifying volume. Alternatively, the speaker may be used as a small sound producing means having a small size and volume.

As such, the small-sized speaker may be mounted to a small electronic product, such as a mobile phone, a PDA, or a notebook computer. As the wireless age begins, consumers want to consume various contents regardless of time and place and demand portability. In order to satisfy the consumers' desires, speakers are tending towards miniaturization and lightness.

A speaker, which is mounted to an electronic product that is miniaturized and light, is a micro speaker, and is disclosed in Korean U.M. Registration No. 20-220353, which is entitled "Small Speaker Structure' and Korean Patent No. 10-432615, which is entitled 'Oval Speaker'. The micro speaker disclosed in the cited documents includes a stationary magnetic circuit having one magnet and a movable magnetic circuit having a coil that is wound circularly.

However, there is a limit to the amount of sound that can be generated by vibrating a diaphragm using one magnet and the coil paired with the magnet.

Thus, although a micro speaker having a smaller volume is required for various kinds of small electronic products, it is impossible to reduce the micro speaker below a predetermined size.

One related solution for resolving the problem mentioned above is to provide the micro speaker with dual magnets. As the amount of the magnets is increased, the length of the voice coil can be reduced, by which, the height of the micro speaker is reduced.

However, according to the magnets, the diaphragm driven by the voice coil should be slim and narrow. While the voice coil vibrates, vibration of the diaphragm along the major-axis direction is not balanced, which affects the sound quality of the micro speaker.

Therefore, it is desirable to provide a speaker which can overcome the above-mentioned problems.

Figure 1:
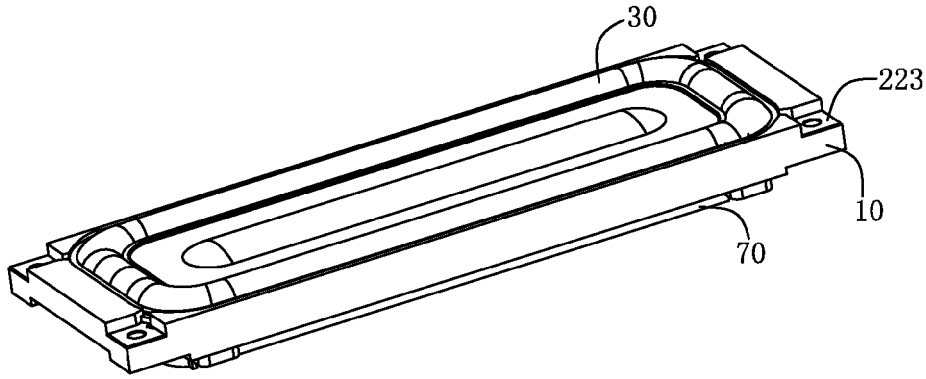
FIG. 1 is an isometric view of an electroacoustic vibrating transducer according to one exemplary embodiment of the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe an exemplary embodiment of the present invention in detail.

Figure 2:
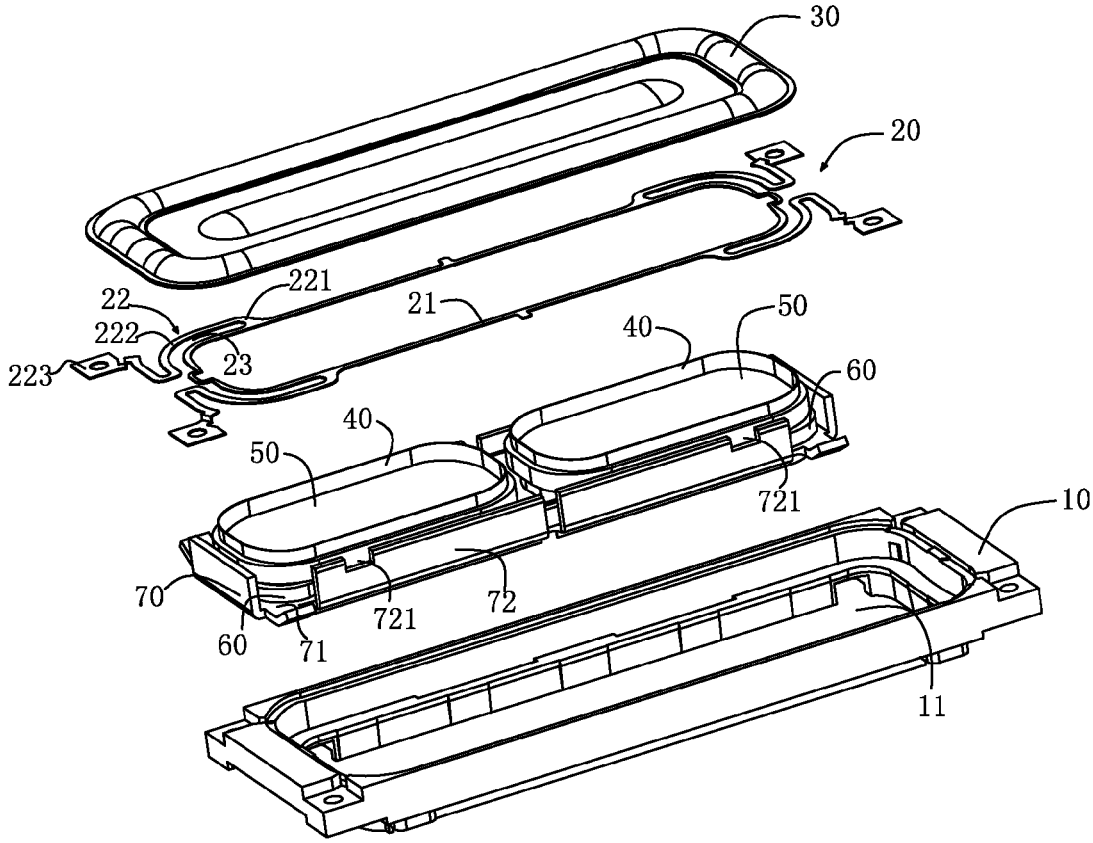
FIG. 2 is an exploded view of the electroacoustic vibrating transducer in FIG. 1.
Figure 3:
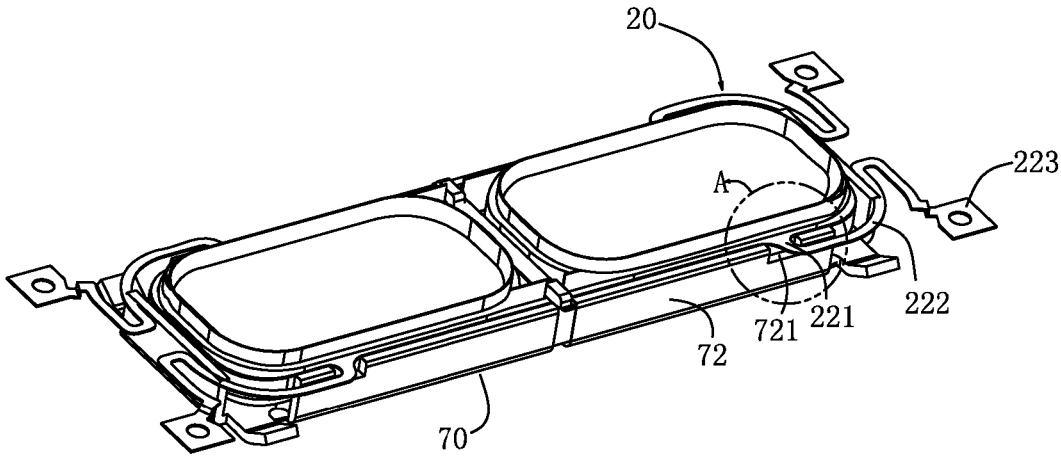
FIG. 3 is an assembled view of the electroacoustic vibrating transducer in FIG. 1, with a frame and a diaphragm thereof being removed.
Figure 4:
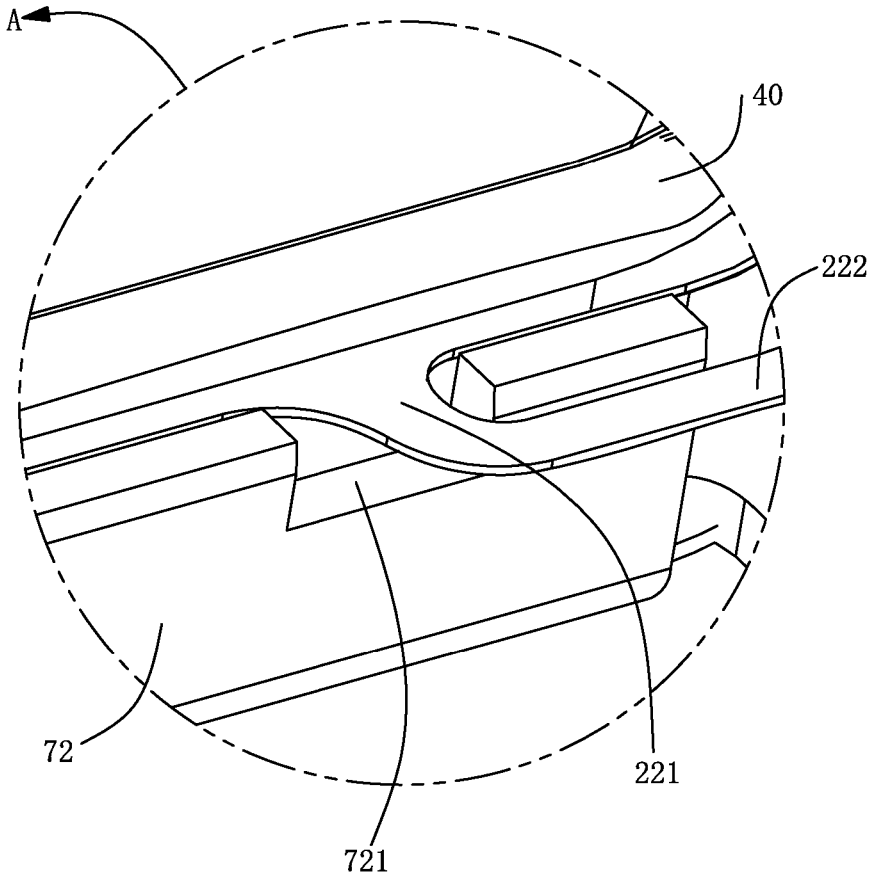
FIG. 4 is an enlarged view of the circled part A in FIG. 3

Referring to FIGS. 1-4, an electroacoustic vibrating transducer comprises a frame 10 forming a hollow space 11, an elastic member 20 mounted on the frame 10, a vibrating member including a diaphragm 30 and a pair of voice coils 40 suspended in the hollow space 11 by the elastic member 20. The elastic member 20 is attached to the diaphragm 30 and is electrically connected to leads of the voice coils 40. The voice coils 40 can receive electrical signals via the elastic member 20.

The electroacoustic vibrating transducer further comprises a magnetic circuit part having a yoke 70 defining a receiving cavity and a pair of magnets 60 received in the receiving cavity of the yoke 70, and a pair of plates 50 respectively attached to surfaces of the two magnets 60. The frame 10 accommodates the elements mentioned above therein.

The elastic member 20 comprises a circular plane lamina 21 and a plurality of elastic arms 22 extending outwardly from a circumference of the circular plane lamina 21. In this exemplary embodiment, four elastic arms are provided to support the circle plane lamina 21. The elastic arms 22 are completely symmetrical about a major-axis and a minor-axis of the circular plane lamina 21. Each of the elastic arms 22 is provided with a bending portion 221 extending from the edge of the circular plane lamina 21, a terminal 223 far away from the plane circular lamina 21, and a serpentine ring 222 smoothly connected the bending portion 221 to the terminal 223. The serpentine rings 222 are configured to be parts of a circle; the circle has a same outline as that of the circular plane lamina 21. Further, a groove 23 is provided between the serpentine ring 222 and the circular plane lamina 21 for enhancing the elasticity of the elastic arm 22.

The yoke 70 defines a bottom 71 and a sidewall 72 surrounding and approximately perpendicular to the bottom 71. The receiving cavity is formed by the bottom 71 and the sidewall 72. The sidewall 72 defines a plurality of gaps 721 corresponding to the elastic arms 22. While assembled, each of the bending portions 221 is suspended above the gap 721. When the diaphragm 30 vibrates, the elastic member 20 vibrates and each of the bending portions 221 is intermittently received in the gap 721 for avoiding dump between the elastic member 20 and the yoke 70. Further, in order to restrict the vibrating direction of the elastic member 20, the sidewall 72 is partially received in the grooves 23.

Be noted that even though the transducer is provided with two magnets and two voice coils in the exemplary embodiment, the disclosure is not limited to the configuration described above. In fact, the transducer may be provided with one magnet and one voice coil, or other amount.

While the present invention has been described with reference to the specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An electroacoustic vibrating transducer, comprising:

a frame defining a hollow space;

an elastic member mounted on the frame, the elastic member defining a circular plane lamina and a plurality of elastic arms extending outwardly from a circumference of the circular plane lamina;

a magnetic circuit part defining a yoke and a magnetic gap;

a vibrating member defining a diaphragm and at least one voice coil suspended in the receiving cavity by the elastic member; wherein the yoke includes a bottom wall and a sidewall extending vertically from the bottom wall, the sidewall defining a plurality of gaps corresponding to the elastic arms for partially receiving the elastic arms during the vibration of the elastic member.

2. The electroacoustic vibrating transducer as described in claim 1, wherein the elastic arms are symmetrical about a major-axis and a minor-axis of the circular plane lamina.

3. The electroacoustic vibrating transducer as described in claim 1, wherein each of the elastic arms comprises a bending portion extending from the circular plane lamina, a terminal far away from the plane circular lamina, and a serpentine ring smoothly connecting the bending portion with the terminal.

4. The electroacoustic vibrating transducer as described in claim 1, wherein the vibrating member includes two voice coils attached to the diaphragm.

5. The electroacoustic vibrating transducer as described in claim 1, wherein the magnetic circuit part includes a pair of magnets located on the yoke with a pair of plates covering top surfaces of the magnets.

* * * * *